US011346529B2

(12) United States Patent
Morand

(10) Patent No.: US 11,346,529 B2
(45) Date of Patent: May 31, 2022

(54) LAMP WITH MOVING PATTERN ILLUMINATION

(71) Applicant: ENTA DESIGN INC., Montreal (CA)

(72) Inventor: Michel Morand, Verdun (CA)

(73) Assignee: ENTA DESIGN INC, Montreal (CA)

( * ) Notice: Subject to any disclaimer, the term of this patent is extended or adjusted under 35 U.S.C. 154(b) by 0 days.

(21) Appl. No.: 17/046,350

(22) PCT Filed: Apr. 9, 2019

(86) PCT No.: PCT/CA2019/050429
§ 371 (c)(1),
(2) Date: Oct. 9, 2020

(87) PCT Pub. No.: WO2019/195930
PCT Pub. Date: Oct. 17, 2019

(65) Prior Publication Data

US 2021/0156542 A1 May 27, 2021

Related U.S. Application Data

(60) Provisional application No. 62/654,885, filed on Apr. 9, 2018, provisional application No. 62/665,604, filed on May 2, 2018.

(51) Int. Cl.

| | |
|---|---|
| ***F21V 14/02*** | (2006.01) |
| ***F21V 3/02*** | (2006.01) |
| ***F21V 11/14*** | (2006.01) |
| ***F21V 19/00*** | (2006.01) |
| ***F21Y 115/10*** | (2016.01) |

(52) U.S. Cl.
CPC ..... *F21V 14/02* (2013.01); *F21V 3/02* (2013.01); *F21V 11/14* (2013.01); *F21V 19/003* (2013.01); *F21Y 2115/10* (2016.08)

(58) Field of Classification Search
CPC . F21V 14/02; F21V 3/02; F21V 11/14; F21V 19/003; F21V 14/025; F21V 17/16;
(Continued)

(56) References Cited

U.S. PATENT DOCUMENTS 4,847,739 A * 7/1989 Saraceni ..... F21S 10/02 362/232
4,858,079 A * 8/1989 Ohashi ..... A63H 5/00 362/35

(Continued)

FOREIGN PATENT DOCUMENTS

CN 207112463 U 3/2018
CN 108087763 A 5/2018
CN 07796637 U 8/2018

(Continued)

OTHER PUBLICATIONS

International Search Report for corresponding application PCT/CA2019/050429 filed Apr. 9, 2019; dated Jun. 20, 2019.

(Continued)

*Primary Examiner* — Peggy A Neils
(74) *Attorney, Agent, or Firm* — Cantor Colburn LLP

(57) ABSTRACT

A lamp comprises a motor having a shaft. A rotor is driven by the shaft to rotate about a first rotational axis and having an offset support defining a second rotational axis that is not parallel to the first rotational axis and that is offset from the first rotational axis. A light source is mounted to the offset support so as to rotate about the second rotational axis, the light source having one or more lights. A system constrains movement of the light source relative to the second rotational axis when the rotor rotates about the first rotational axis. A controller unit actuates the motor and the light source.

20 Claims, 3 Drawing Sheets

(58) Field of Classification Search
CPC ..... F21W 2121/00; F21L 4/027; F21S 10/06; F21Y 2115/10
See application file for complete search history.

(56) References Cited

U.S. PATENT DOCUMENTS

| | | | | | |
|---|---|---|---|---|---|
| 5,041,947 | A * | 8/1991 | Yuen | F21S 10/06 | 362/35 |
| 5,269,719 | A * | 12/1993 | Klawitter | F21S 10/06 | 362/35 |
| 9,121,559 | B2 * | 9/2015 | Johnson | F21V 13/02 | |
| 2007/0242225 | A1 * | 10/2007 | Bragg | G03B 31/04 | 352/12 |
| 2015/0308662 | A1 * | 10/2015 | Vice | F21V 21/30 | 362/282 |
| 2016/0153630 | A1 * | 6/2016 | Dong | F21S 10/046 | 362/284 |

FOREIGN PATENT DOCUMENTS

| | | | |
|---|---|---|---|
| KR | 200466906 | Y1 | 5/2013 |
| WO | 2013116548 | A1 | 8/2013 |

OTHER PUBLICATIONS

Written Opinion of the International Searching Authority for corresponding application PCT/CA2019/050429 filed Apr. 9, 2019; dated Jun. 20, 2019.
European Search Report for corresponding application EP19785384; Report dated Feb. 18, 2021.

* cited by examiner

LAMP WITH MOVING PATTERN ILLUMINATION

CROSS-REFERENCE TO RELATED APPLICATION

The present application claims the priority of U.S. Patent Application No. 62/654,885, filed on Apr. 9, 2018, and No. 62/665,604, filed on May 2, 2018, both of which are incorporated herein by reference.

TECHNICAL FIELD

The present disclosure relates lamps of the type producing a moving pattern of illumination, such lamps used for example in infant or children rooms.

BACKGROUND OF THE ART

To assist in the process of putting infants or children to sleep, lamps producing moving patterns of illumination are commonly used. Such lamp project patterns of light on walls to distract the children. One challenge is that the movement of the patterns of light be more than linear or circular, to assist in distracting the children. Another challenge conflicting with the desire for more complex movements of the patterns is the cost of such lamps. It is indeed desired to keep such lamps at a low manufacturing price.

SUMMARY

According to an embodiment of the present disclosure, there is provided a lamp comprising: a motor; a rotor driven by the motor to rotate about a first rotational axis and having an offset support defining a second rotational axis that is not parallel to the first rotational axis and that is offset from the first rotational axis; a light source mounted to the offset support so as to rotate about the second rotational axis, the light source having one or more lights; a system for constraining movement of the light source relative to the second rotational axis when the rotor rotates about the first rotational axis; and a controller unit for actuating the motor and the light source.

Further in accordance with the embodiment, for example, the first rotational axis is upright.

Still further in accordance with the embodiment, for example, the rotor is mounted directly to the shaft.

Still further in accordance with the embodiment, for example, a transmission is between the rotor and the shaft.

Still further in accordance with the embodiment, for example, the transmission is a reduction transmission.

Still further in accordance with the embodiment, for example, the offset support is a hub rotatingly supporting the light source.

Still further in accordance with the embodiment, for example, the rotor has a base component coupled to the shaft, and a top component connected to the base component, the hub being on the top component.

Still further in accordance with the embodiment, for example, the offset support defines a sliding plane upon which the light source is mounted and slides when rotating about the second rotational axis, a vector of the second rotational axis being normal to the sliding plane.

Still further in accordance with the embodiment, for example, the light source includes a plate connected to the offset support for rotation about the second rotational axis, the one or more lights being mounted to the plate.

Still further in accordance with the embodiment, for example, the plate is a printed circuit board, and the one or more lights is one or more light-emitting diodes.

Still further in accordance with the embodiment, for example, the light source is displaceable in at least two rotational degrees of freedom for a single degree of actuation from the motor.

Still further in accordance with the embodiment, for example, a bottom shell and a top shell concurrently define a cavity for enclosing at least the motor, the rotor, the light source and the mechanism.

Still further in accordance with the embodiment, for example, a support plate is in the cavity, with the motor being in a first subcavity defined by the support plate and the bottom shell.

Still further in accordance with the embodiment, for example, a thoughbore is defined in the support plate for the shaft to pass therethrough to be connected to the rotor in a second subcavity defined by the support plate and the top shell.

Still further in accordance with the embodiment, for example, the support plate is secured to the bottom shell by micro-fasteners.

Still further in accordance with the embodiment, for example, the bottom shell and top shell are interconnected by tongue and groove sets.

Still further in accordance with the embodiment, for example, the top shell is entirely made of a transparent and/or translucent material.

Still further in accordance with the embodiment, for example, the system is a cable tethering the light source.

Still further in accordance with the embodiment, for example, the cable is a power cable connecting the controller unit to the light source.

Still further in accordance with the embodiment, for example, the cable is a dedicated tether cable.

In accordance with another embodiment of the present disclosure, there is provided a lamp comprising: a motor; a rotor driven by the motor to rotate about a first rotational axis and having an offset support defining a sliding plane having a normal that is not parallel to the first rotational axis; a light source mounted to the offset support so as to move along the sliding plane, the light source having one or more lights; a system for constraining movement of the light source relative to the sliding plane when the rotor rotates about the first rotational axis; and a controller unit for actuating the motor and the light source.

Further in accordance with the other embodiment, for example, the first rotational axis is upright.

Still further in accordance with the other embodiment, for example, the rotor is mounted directly to the shaft.

Still further in accordance with the other embodiment, for example, a transmission is between the rotor and the shaft.

Still further in accordance with the other embodiment, for example, the transmission is a reduction transmission.

Still further in accordance with the other embodiment, for example, the offset support has a hub around which the light source is mounted, the hub limiting movements of the light source.

Still further in accordance with the other embodiment, for example, the rotor has a base component coupled to the shaft, and a top component connected to the base component, the hub being on the top component.

Still further in accordance with the other embodiment, for example, the light source is rotatatble relative to a second rotational axis passing through the hub, a vector of the second rotational axis being parallel to the normal to the sliding plane.

Still further in accordance with the other embodiment, for example, the light source includes a plate connected to the offset support, the one or more lights being mounted to the plate.

Still further in accordance with the other embodiment, for example, the plate is a printed circuit board, and the one or more lights is one or more light-emitting diodes.

Still further in accordance with the other embodiment, for example, the light source is displaceable in at least two degrees of freedom for a single degree of actuation from the motor.

Still further in accordance with the other embodiment, for example, a bottom shell and a top shell concurrently define a cavity for enclosing at least the motor, the rotor, the light source and the mechanism.

Still further in accordance with the other embodiment, for example, a support plate is in the cavity, with the motor being in a first subcavity defined by the support plate and the bottom shell.

Still further in accordance with the other embodiment, for example, a thoughbore is defined in the support plate for the shaft to pass therethrough to be connected to the rotor in a second subcavity defined by the support plate and the top shell.

Still further in accordance with the other embodiment, for example, the support plate is secured to the bottom shell by micro-fasteners.

Still further in accordance with the other embodiment, for example, the bottom shell and top shell are interconnected by tongue and groove sets.

Still further in accordance with the other embodiment, for example, the top shell is entirely made of a transparent and/or translucent material.

Still further in accordance with the other embodiment, for example, the system is a cable tethering the light source.

Still further in accordance with the other embodiment, for example, the cable is a power cable connecting the controller unit to the light source.

Still further in accordance with the other embodiment, for example, the cable is a dedicated tether cable.

In accordance with yet another embodiment of the present disclosure, there is provided a method for illuminating an environment comprising: powering a light source emitting light to illuminate the environment; operating a motor to cause a rotation of the light source about a first rotational axis; constraining the rotation of the light source about a second rotational axis, the second rotational axis being non parallel and offset from the first rotational axis.

Further in accordance with the other embodiment, for example, constraining the rotation of the light source includes tethering the light source with a cable.

Still further in accordance with the other embodiment, for example, operating the motor to cause a rotation and constraining the rotation of the light source causes a non orbital non cyclic movement of the light source.

Still further in accordance with the other embodiment, for example, the method is performed to cause movements of the light source in at least two rotational degrees of freedom for a single degree of actuation from the motor.

Still further in accordance with the other embodiment, for example, further comprising passing the light from the light source through a translucent and/or transparent lens.

Still further in accordance with the other embodiment, the light passes from the light source through windows free of material in the translucent and/or transparent lens.

DETAILED DESCRIPTION

Figure 1:
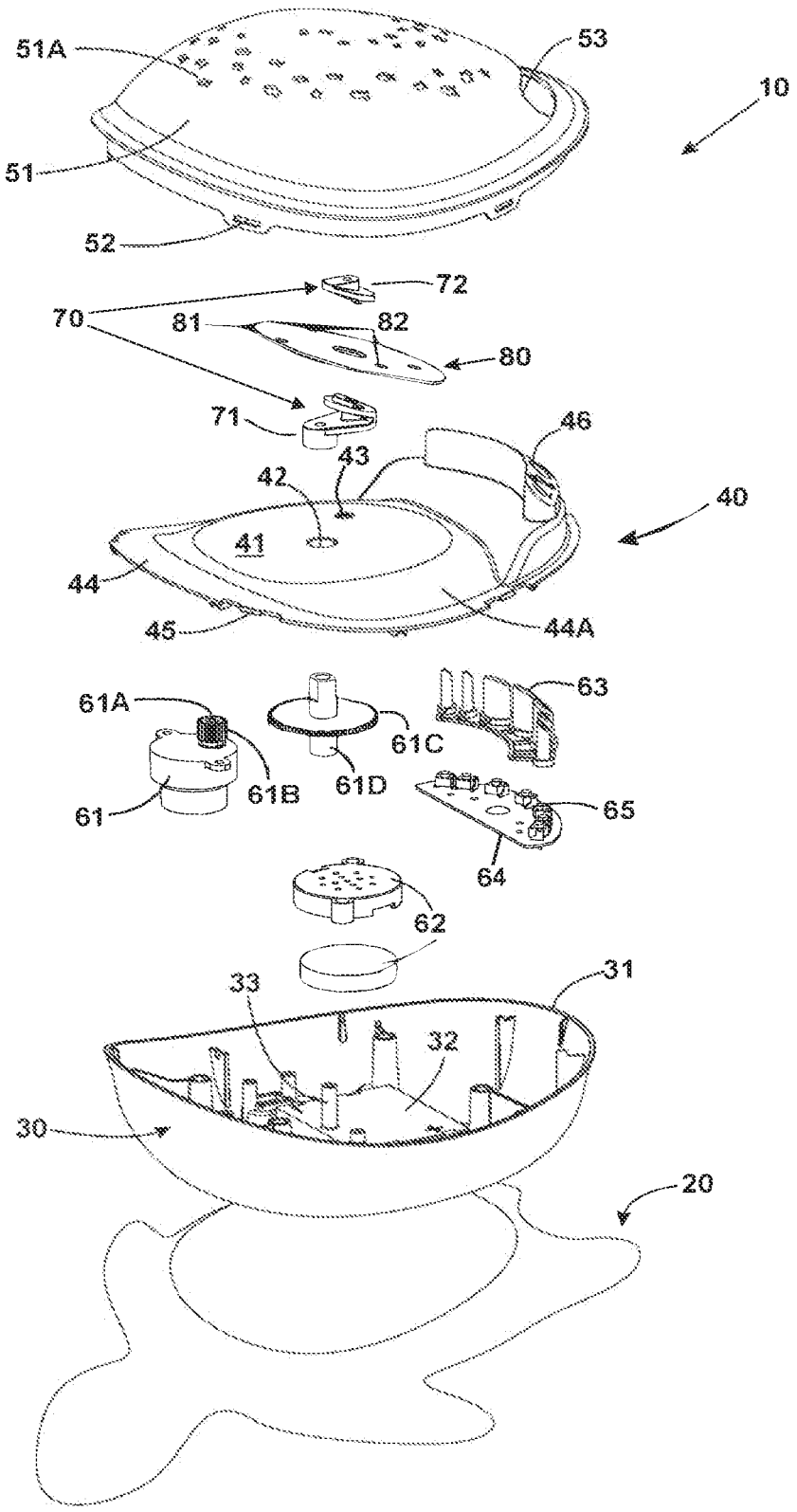
FIG. 1 is an assembly view of a lamp with moving pattern illumination in accordance with an embodiment, the present disclosure.

Referring to the drawings and more particularly to FIG. 1, a lamp with moving pattern illumination in accordance with the present disclosure is generally shown at 10. The lamp with moving pattern illumination 10 may have one or more of the following components: a decorative body 20 such as a plush body, a bottom shell 30, a support plate 40, a top shell 50, a controller unit 60, a rotor 70 and/or a light source 80.

The decorative body 20 forms the decorative feature of the lamp with moving pattern illumination 10. If present, it may adopt any esthetically pleasing geometry. The decorative body 20 may or may not be present. In an embodiment, the decorative body 20 is a plush body. In FIG. 1, the plush body 20 is shaped as a turtle, but this is an example among others. The body 20 may be other animals, vegetables and fruits, objects (car, plane), etc. Moreover, the body 20 need not only be made of plush, as other materials may also be used. For example, the body 20 may be made of a rubbery material molded to any appropriate shape, as an example.

Figure 2:
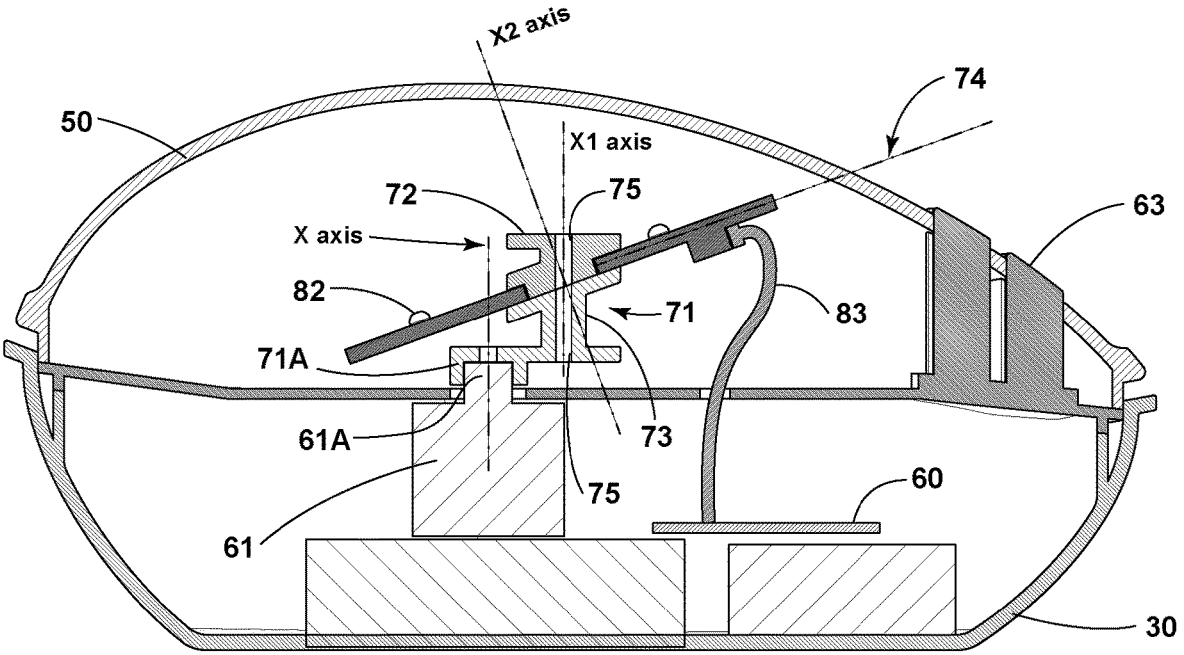
FIG. 2 is a longitudinal cross-section schematic view of the lamp with moving pattern illumination in accordance with another embodiment of the present disclosure.
Figure 3:
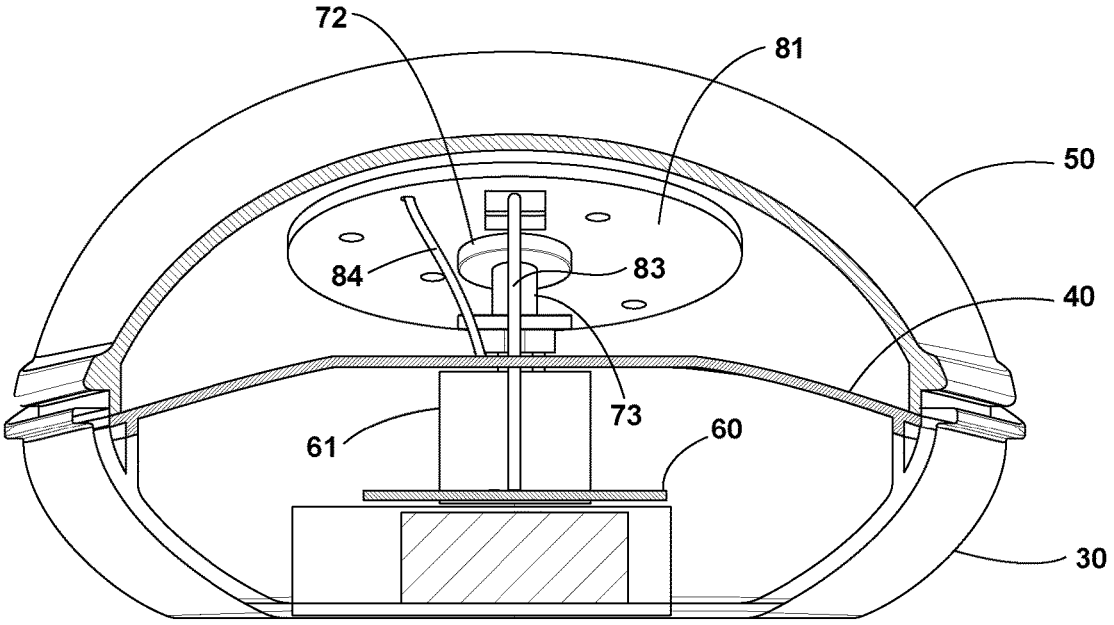
FIG. 3 is a transverse cross-section schematic view of the lamp with moving pattern illumination of FIG. 2.
Figure 4A:
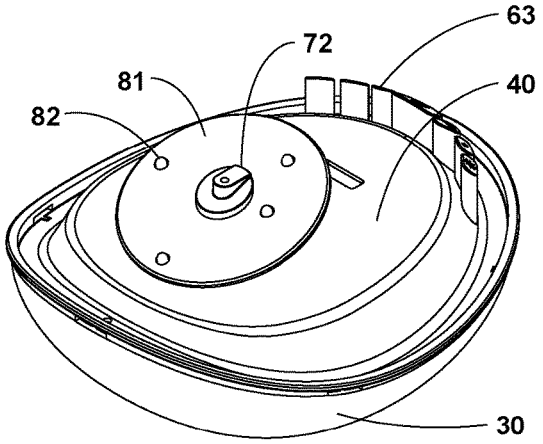
FIGS. 4A to 4D are perspective views of the lamp with moving pattern illumination of FIG. 1, with top shell removed, to illustrate a movement of a light source.
Figure 4B:
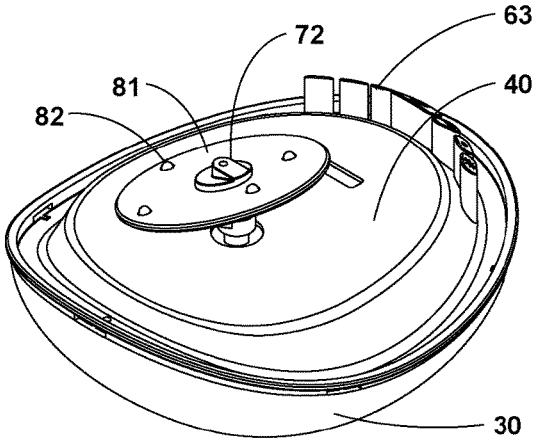
Figure 4C:
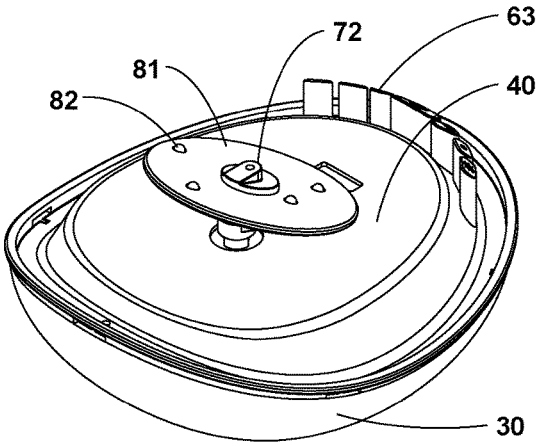
Figure 4D:
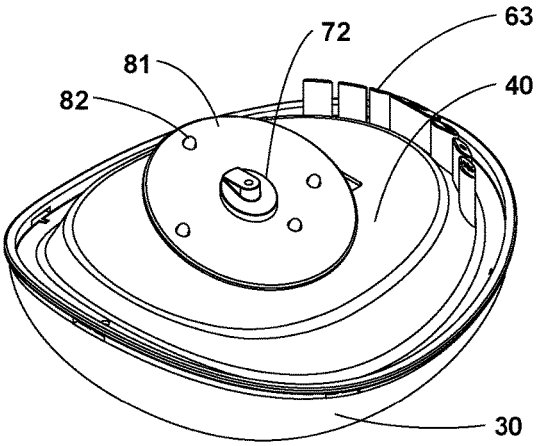

The bottom shell 30 defines the structural base of the lamp with moving pattern illumination 10. In an embodiment, there may be no decorative body 20, whereby the bottom shell 30 may be an exposed components of the lamp 10. Hence, the bottom shell 30 may have esthetic and/or decorative features. The bottom shell 30 may be made of plastic, metal, etc, and is configured to enclose or support the other components of the lamp with moving pattern illumination 10. For instance, some of the technical components of the lamp 10 may be concealed inside the bottom shell 30. The bottom shell 30 may be an open-ended receptacle, and may provide an access from its underside for batteries. Because the lamp 10 is used in the vicinity of children, the construction of the bottom shell 30 must be child-proof in terms of being opened or broken. A peripheral edge 31 of the bottom shell 30 may have any appropriate shape, such as the saddle contour shown, as one of numerous embodiments, with upstanding posts for the securing of other components to the bottom shell 30. Such posts have a tapped bore for receiving fasteners. Various geometric features may be present, such as a battery casing 32 for receiving a battery therein, among a possibility. The casing 32 and other molded features (e.g., the upstanding posts) may or may not be present. FIGS. 2 and 3 show for example a simplified bottom shell 30. Fasteners such as screws, rivets, bolts and nuts, metal inserts with threading, may be used, as one example. In an embodiment, the bottom shell 30 may be monoblock, although it may also have a door or removable plate, for instance to access an interior thereof, such as a battery receptacle, if batteries may be replaced. Moreover, although not shown, port holes may be defined in the bottom shell 30 for connection of a rechargeable wire, for example. A pivot post 33 may be present, to support parts of a transmission. The pivot post 33 may be an integral part of the bottom shell 30, such as being comolded therewith.

The support plate 40 may be mounted onto the bottom shell 30 to conceal some of the technical components of the lamp with moving pattern illumination 10. In an embodiment, the presence of the support plate 40 is an additional safety measure for minute components not to be accessible to children. According to an embodiment, the support plate 40 has a support platform 41 that supports rotating components. The support platform 41 may be a generally planar or continuous surface, other than for some holes therein. However, other geometries may be used as well.

A throughbore 42 may be defined in the support platform 41 for transmission of a rotational movement therethrough, as explained hereinafter. A hole or slot 43 may also be defined in the support platform 41 for a wire to extend from the controller unit 60 to the light source 80, as described hereinafter. In an embodiment, there is no additional hole or slot 43, as a wire may pass through the throughbore 42. Also, the throughbore 42 may be larger than what is shown in FIG. 1 to extend to a location of a wire. However, the size and configuration of FIG. 1 is well suited to isolate the technical components in a generally closed cavity or volume formed jointly by the bottom shell 30 and the support plate 40. The support plate 50 may divide a global cavity formed by both the bottom shell 30 and the top shell 50 in a first and a second subcavity.

The support platform 41 may be raised relative to a remainder of the support plate 40, to define an under concavity with which the volume concurrently defined with the bottom shell 30 is increased, for storing some of the components of the lamp 10. This is one possible configuration as the support plate 40 may be flat from end to end, or even concave from a top perspective to reduce the volume of the closed cavity. The support plate 40 may have a skirt 44A with a peripheral flange 44 for assembly with an edge of the top shell 50, via tongues 45 as one possible embodiment, others including bolts, screws, etc. Also, for connection to the bottom shell 30, bolts or screws may be circumferentially distributed in holes of the flange 44, with corresponding threaded bores in the bottom shell 30, in the upstanding posts. In an embodiment, the bolts or screws are micro fasteners, to further assist in childproofing the lamp 10. The support plate 40 may be a monoblock body. The peripheral flange 44 and skirt 44A may be present to adapt the support platform 41 to the non-flat shape of the peripheral edge 31 of the bottom shell 30. The shape of the peripheral edge 31 may warrant other shapes for the support plate 40, if the support plate 40 is present. A pushbutton mount 46 may be formed in the support platform 41, to house some of the components of a user interface, described hereinafter. The pushbutton mount 46 may have holes for projection of the pushbuttons therethrough.

The top shell 50 may form the outer visible shell of the lamp with moving pattern illumination 10. The top shell 50 may be partially or completely transparent or translucent, to allow light to pass through it. In an embodiment, the top shell 50 has a window of transparent or translucent material, with an opaque or translucent frame. In yet another embodiment, the top shell 50 is a monoblock body. The top shell 50 may therefore act as a lens, at least through its lens portion 51. In an embodiment, the top shell 50 is colored to color the light that passes through it. The top shell 50 may also define openings 51A, as in FIG. 1, having specific geometry shapes (e.g., fish) such that the light patterns projected onto the walls have given shapes. In another embodiment, the top shell 50 may have surface features resulting in material thickness, to affect a diffusion of light therethrough. In an embodiment, the top shell 50 is opaque or has opaque portions with light passing through the openings 51A. In another embodiment, the lens portion 51 of the top shell 50 in transparent or translucent with a colour filter, such that light passing through the openings 51A is in a color that is distinct from the light passing through the material of the top shell 50. Any of these embodiments may be combined. The top shell 50 may be connected in any appropriate way to a remainder of the lamp 10. As shown in FIG. 1, slots 52 may be present for snap-fit engagement with corresponding tongues 45 in the support plate 40. The top shell 50 is preferably made of a child-proof plastic that is impact resistant. The tongues 45 may be elastically deformable for attaching or detaching the top shell 50 from the support plate 40. In an embodiment, a tool such as a flat screwdriver may be required to wedge the tongues 45 out of engagement with the corresponding slots 52. In yet another embodiment, an alternative arrangements (e.g., the reverse arrangement) of slots in the support plate 40 and tongues in the top shell 50 may be present. A window 53 may also be defined in the top shell 50. The window 53 may be in alignment with the pushbutton mount 46, if present, for the interface to be accessed. In an embodiment, there are individual windows 53 for the push buttons. In yet another embodiment, the push buttons do not pass through the top shell 50.

A controller unit 60 is the powered component of the lamp with moving pattern illumination 10. It receives the power supply (e.g., from batteries, from a power cord), and operates some of the components, such as a motor 61 with a shaft 61A. In an embodiment, the batteries are integrated rechargeable batteries, whereby a recharge port may be present, or a capacity for wireless charging. The motor 61 may be a low voltage, low current motor, and may include a transmission and/or a reduction mechanism to reduce a speed of rotation. The reduction mechanism may be integrated inside the motor 61, Accordingly, the shaft 61A may be part of the rotor of the motor 61, or may be that of a reduction mechanism or transmission effecting a speed change from the shaft of the motor 61. In an embodiment, the reduction mechanism includes a first gear 61B mounted to the shaft 61A. The first gear 61B is meshed with a second gear 61C mounted on a shaft 61D. The second gear 61C is larger than the first gear 61B, whereby the shaft 61D has a lower angular speed than the shaft 61A. The shaft 61D may be mounted to the pivot post 33, and hence be an "idler". The transmission may have other configurations, including pulleys and a belt or tendon, a gearbox, etc.

An optional a music producing unit having a speaker 62 may be present as part of the controller unit 60. The controller unit 60 may receive commands from pushbuttons 63, for instance as part of a printed circuit board 64 (e.g., mother board) and/or paired with switches 65 on the PCB 64, and may consequently produce light and music as a function of the operator commands. According to an embodiment, the controller unit 60 has a micro-processor with appropriate chips and electronic components, for example on the PCB 64 supporting the pushbuttons 63 in FIG. 1, to enable the various functionalities. The functionalities include on/off, intermittent lighting, intermittent colour, rotational speed variation, and/or auto shut-off (e.g. a sleep function), among others, and in any combination thereof. The motor 61 may be positioned such that the shaft 61A projects upwardly through the throughbore 42 and above a plane of the support platform 41. The shaft 61A may thus be generally upright, in an embodiment.

The rotor 70 is mounted to the shaft 61D, or to the shaft 61A in the embodiment of FIGS. 2 and 3, to receive a drive of the motor 61 for instance via a reduction mechanism or transmission (e.g., direct drive, indirect drive through a transmission, referred to in both cases as the motor 61 driving the rotor 70, the rotor 70 driven by the motor 61). The rotor 70 supports the light source 80. The rotor 70 is tasked with converting the one degree-of-freedom (DOF) rotational output from the shaft 61A into a movement with more than one DOF and/or into a non orbital non cyclic movement of the light source 80. Stated differently, the light source 80 may be displaceable in two or more degrees of freedom for a single degree of actuation from the motor 61. One embodiment of the rotor 70 is shown in FIG. 2. In the embodiment of FIG. 2, the rotor 70 has a base component 71 and a top component 72. The base component 71 is connected to the shaft 61A and hence rotates about axis X. According to an embodiment, the base component 71 has a shaft bore or coupler 71A for receiving the shaft 61A therein (or 61D in another embodiment). The base component 71 may also have an offset support 73 having its axis X1 offset from axis X of the shaft 61A or 61D (eccentric relation). Therefore, when the motor 61 is actuated, the axis X1 may have an orbital path relative to axis X. The movement may be an orbital cyclic circular movement, for example. In an embodiment, axes X and X1 are parallel to one another, though this may be optional. The offset support 73 may also have a sliding plane 74 that is in an oblique relation relative to the axis X1. Stated differently, a vector of the axis X1 is not normal to the sliding plane 74. The sliding plane 74 has a normal X2. The top component 72 may serve as a hub for a rotation of the light source 80 thereon, about the normal X2. Moreover, the top component 72 may act as a retainer to hold the light source 80 captive with the base component 71. In an embodiment, the base component 71 and the top component 72 form a continuous bore 75 to receive a fastener. The continuous bore 75 may be centered on axis X1 for example. As an alternative, a screw, a bolt, with for example a washer, could be used as an alternative to the top component 72. The bore 75 could be solely in the base component 71, and be oriented along X2, with a fastener received in the bore 75.

Referring to FIGS. 1 to 3, the light source 80 may be in the form a plate 81 supporting light-emitting diodes (LEDs) 82. For example, the plate 81 may be a printed-circuit board (PCB) supporting the LEDs 82. The LEDs 82 may be of any color. As shown in FIGS. 2 and 3, a wire 83 may extend from a part of the controller unit 60 to the light source 80, for the controller unit 60 to power the light source 80. Accordingly, the plate 81 is tethered by way of the wire 83. A dedicated tethering cable 84, a.k.a., tether, may additionally be provided to perform the tethering, as described hereinbelow. Other types of "lights" may be used, including small incandescent light bulbs, etc. In an embodiment, LEDs are well suited due to their low energy consumption, lifetime and robustness. Moreover, as the light source 80 may be operated to switch colors, with intermittence, etc, the high response rate of LEDs to switching may be suited for the lamp 10. Any appropriate types of LEDs may be used for the light source 80. Four different LEDs 82 are shown in the figures, but fewer or more may be present.

The top component 72 or equivalent is connected to the base component 71 is such a way that the plate 81 is free to rotate relative to the axis X2. The bottom of the top component 72 forms a hub for a rotation of the plate 81. The rotation of the plate 81 is constrained by the tethering of the wire 83 and/or the wire 84, having a length selected to cause some pulling action on the plate 81 through an orbital rotation of the axis X1 relative to axis X. As observed from the sequence of FIGS. 4A to 4D, this may result in a reciprocating upward-downward movement of the LEDs 82 as the plate 81 rotates with the rotor 70, as rendered possible by the oblique relation of the plate 81 on the rotor 70. This is combined to the orbital movement of axis X1. Accordingly, at least two DOFs of movement are caused by a combination of the features of the rotor 70 and tethering by the wire 83/cable 84. The movement may be described as a sinuous movement due to the reciprocating effect resulting from the tethering.

As an alternative to the tethering with the wire 83, it is contemplated to provide a cam/guide and follower assembly, as another possible embodiment. Another contemplated mechanism includes a stop post and abutment. For instance a cam/guide could be on the support plate 40, and a follower slot may be defined in the plate 81. As yet another possibility, the tethering cable 84 is provided. The tethering cable 84 may be made of steel or like robust material, so as to be capable of being tasked with the pulling action. Indeed, as the wire 83 serves a purpose of powering the LEDs 82, it may be best not to rely on the wire 83 for repeatedly performing the pulling action.

The lamp 10 described as being of the type used to provide illumination in children's rooms. However, there are other contemplated uses for the lamp 10. For instance, the moving patterns of illumination produced by the lamp 10 may be used in dynamic decors in public and/or domestic settings. For example, the lamp 10 may be integrated to club settings, in a similar manner as stroboscopes and/or disco balls (i.e., mirrored glass balls).

The lamp 10, or a similar lamp, may be operated for illuminating an environment, with steps such as powering a light source emitting light to illuminate the environment; operating a motor to cause a rotation of the light source about a first rotational axis; and constraining the rotation of the light source about a second rotational axis, the second rotational axis being non parallel and offset from the first rotational axis. Constraining the rotation of the light source includes tethering the light source with a cable. Operating the motor to cause a rotation and constraining the rotation of the light source causes a non orbital non cyclic movement of the light source. The method may be performed to cause movements of the light source in at least two rotational degrees of freedom for a single degree of actuation from the motor. The light from the light source may pass through a translucent and/or transparent lens. In doing so, the light from the light source may pass through windows free of material in the translucent and/or transparent lens.

The invention claimed is:

1. A lamp comprising:

a motor;

a rotor driven by the motor to rotate about a first rotational axis and having an offset support defining a second rotational axis that is not parallel to the first rotational axis and that is offset from the first rotational axis;

a light source mounted to the offset support so as to rotate about the second rotational axis, the light source having one or more lights, the light source being free to rotate about the second rotational axis;

a system for constraining movement of the light source relative to the second rotational axis when the rotor rotates about the first rotational axis; and a controller unit for actuating the motor and the light source.

2. The lamp according to claim 1, wherein the first rotational axis is upright.

3. The lamp according to claim 1, wherein the rotor is mounted directly to a shaft of the motor.

4. The lamp according to claim 1, comprising a transmission between the rotor and a shaft of the motor.

5. The lamp according to claim 4, wherein the transmission is a reduction transmission.

6. The lamp according to claim 1, wherein the offset support is a hub rotatingly supporting the light source.

7. The lamp according to claim 6, wherein the rotor has a base component coupled to a shaft of the motor, and a top component connected to the base component, the hub being on the top component.

8. The lamp according to claim 1, wherein the offset support defines a sliding plane upon which the light source is mounted and slides when rotating about the second rotational axis, a vector of the second rotational axis being normal to the sliding plane.

9. The lamp according to claim 1, wherein the light source includes a plate connected to the offset support for rotation about the second rotational axis, the one or more lights being mounted to the plate.

10. The lamp according to claim 9, wherein the plate is a printed circuit board, and the one or more lights is one or more light-emitting diodes.

11. The lamp according to claim 1, wherein the light source is displaceable in at least two rotational degrees of freedom for a single degree of actuation from the motor.

12. The lamp according to claim 1, further comprising a bottom shell and a top shell concurrently defining a cavity for enclosing at least the motor, the rotor, the light source and a reduction mechanism.

13. The lamp according to claim 12, further comprising a support plate in the cavity, with the motor being in a first subcavity defined by the support plate and the bottom shell.

14. The lamp according to claim 13, wherein a through-bore is defined in the support plate for a shaft of the motor to pass therethrough to be connected to the rotor in a second subcavity defined by the support plate and the top shell.

15. The lamp according to claim 13, wherein the support plate is secured to the bottom shell by micro-fasteners.

16. The lamp according to claim 12, wherein the bottom shell and top shell are interconnected by tongue and groove sets.

17. The lamp according to claim 12, wherein the top shell is entirely made of a transparent and/or translucent material.

18. The lamp according to claim 1, wherein the system is a cable tethering the light source.

19. The lamp according to claim 18, wherein the cable is a power cable connecting the controller unit to the light source.

20. The lamp according to claim 18, wherein the cable is a dedicated tether cable.

* * * * *